United States Patent [19]

Salatka

[11] 4,197,796

[45] Apr. 15, 1980

[54] ALUMINUM CAN COMPACTOR

[76] Inventor: Robert G. Salatka, 8049 N. 16 Ave., Phoenix, Ariz. 85021

[21] Appl. No.: 2,696

[22] Filed: Jan. 11, 1979

[51] Int. Cl.[2] ..... B30B 1/02

[52] U.S. Cl. ..... 100/293; 100/DIG. 2; 100/295; 248/206 R

[58] Field of Search ..... 100/DIG. 2, 293, 295, 100/281, 283; 248/206 R; 99/583; D15/123; 241/99

[56] References Cited

U.S. PATENT DOCUMENTS

| | | | |
|---|---|---|---|
| 2,563,379 | 8/1951 | Smith | 100/DIG. 2 |
| 2,603,271 | 7/1952 | Heymers | 100/DIG. 2 |
| 2,638,957 | 5/1953 | Danielson | 100/DIG. 2 |
| 2,783,367 | 2/1957 | Locke | 248/206 R |
| 3,918,666 | 11/1975 | Florian | 248/206 R |
| 4,062,283 | 12/1977 | Kaminski | 100/DIG. 2 |

FOREIGN PATENT DOCUMENTS

| | | | |
|---|---|---|---|
| 1156139 | 6/1969 | United Kingdom | 100/DIG. 2 |

*Primary Examiner*—Billy J. Wilhite
*Attorney, Agent, or Firm*—Harry M. Weiss

[57] ABSTRACT

This relates to a compactor for crushing aluminum containers of the type, for example, which contain soft drinks and certain alcoholic beverages. The empty container is placed between a first stationary plate and a second crushing plate. The crushing plate is coupled into a guide assembly and to a handle assembly. Lowering the handle assembly causes the crushing plate to be lowered, guided by the guide assembly, thus crushing the interposed aluminum container.

11 Claims, 7 Drawing Figures

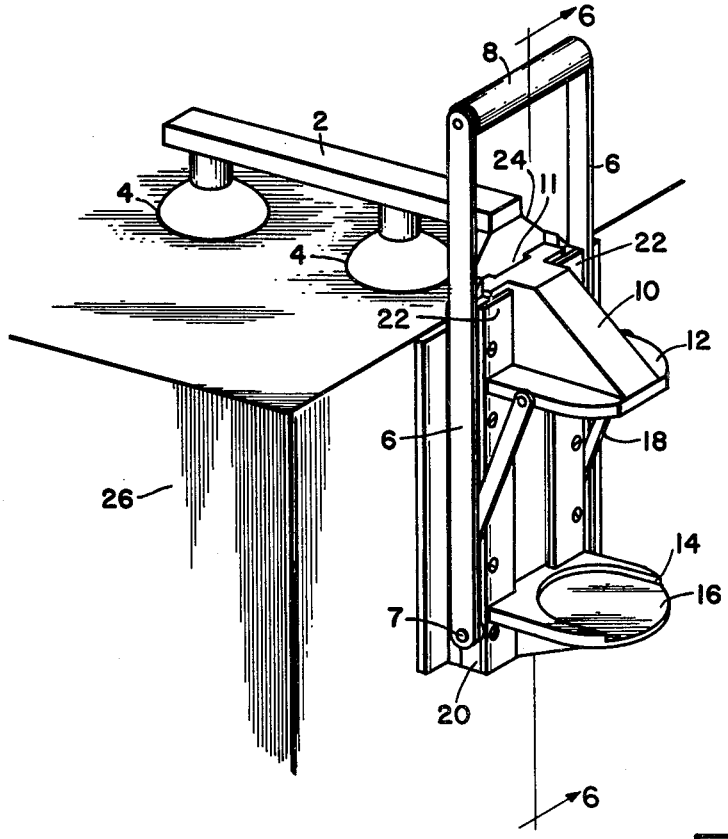
FIG. 1
FIG. 2A
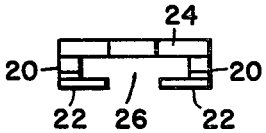
FIG. 2B
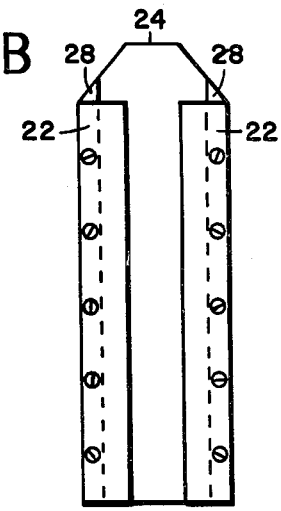
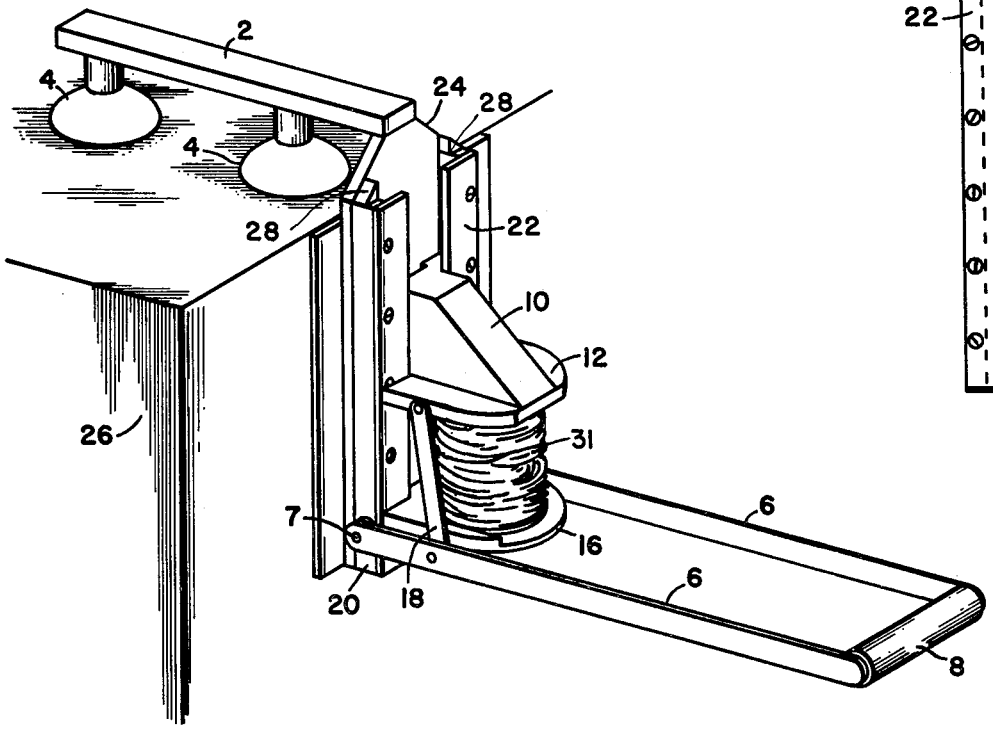
FIG. 4

ALUMINUM CAN COMPACTOR

BACKGROUND OF THE INVENTION

1. Field of the Invention

This relates generally to compactors, and more particularly to an apparatus having first and second substantially parallel crushing surfaces between which an aluminum container is placed and crushed when one of the surfaces is urged towards the other surface.

2. Description of the Prior Art

The practice of re-cycling aluminum containers or cans is common. Many individuals, families, businesses and charitable organizations collect and save aluminum cans for subsequent sale to organizations which re-cycle the aluminum. To be economically worthwhile however, a great number of containers must be collected thus presenting severe storage problems. One solution to this problem calls for crushing the containers so that their compacted volume is only a fraction of that of the uncrushed container.

Devices for compacting or crushing individual aluminum cans are commercially available. These known devices are, however, generally bulky, inefficient and difficult to use.

SUMMARY OF THE INVENTION

It is an object of the present invention to provide an apparatus for crushing or compacting aluminum containers or cans.

It is a further object of the invention that the crushing apparatus be efficient and easy to use so as to permit even children to operate it.

Finally, it is an object of the present invention that the inventive crushing apparatus be easily mounted for home use.

According to a broad aspect of the invention there is provided an apparatus for compacting aluminum containers, comprising guide means, a first plate fixedly coupled to said guide means for supporting a container to be crushed, crushing means slidingly coupled to said guide means and a handle assembly pivotably coupled to said guide means and coupled to said crushing means for urging said crushing means against said container when said handle assembly is lowered.

The above and other objects, features and advantages of the present invention will be more clearly understood from the following detailed description taken in conjunction with the accompanying drawings, in which:

BRIEF DESCRIPTION OF THE DRAWINGS

FIG. 1 is an isometric view of the inventive can compactor;

FIGS. 2*A* and 2*B* are front and top views of the guide assembly used in the compactor of FIG. 1;

FIG. 4 illustrates the apparatus after crushing has commenced;

DESCRIPTION OF THE PREFERRED EMBODIMENT

Figure 3:
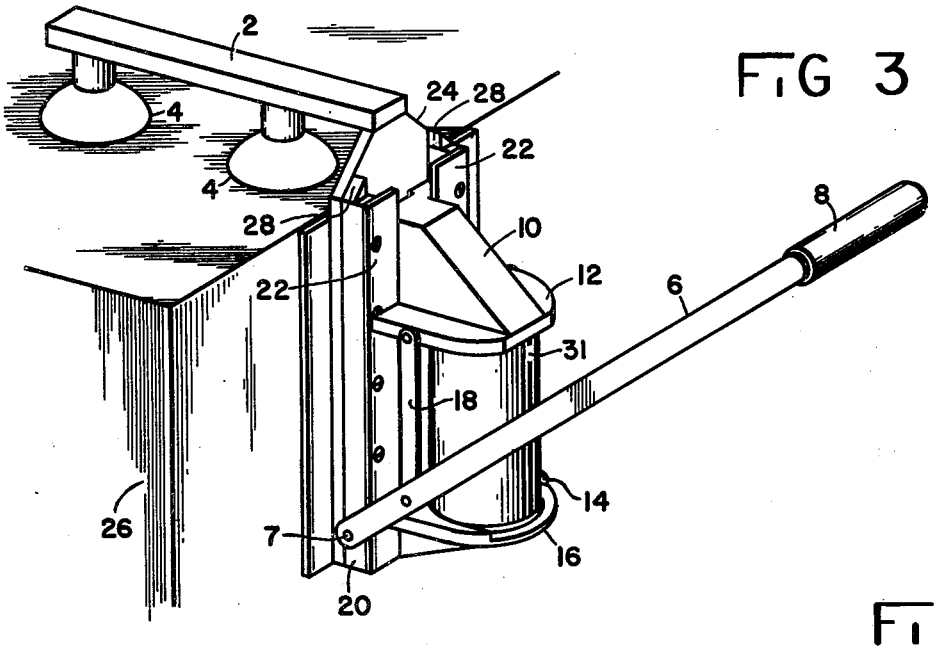
FIG. 3 is a side view of the inventive apparatus after insertion of an aluminum can but prior to crushing.

FIG. 1 shows the inventive compacting apparatus mounted on a support structure 26 (e.g. a household refrigerator) by means of mounting bar 2 which is fastened to the surface of support 26 by, for example, suction discs 4. The crushing assembly includes a lower support plate 16, an upper crushing plate 12, a handle assembly (6 and 8) coupled to the crushing plate and a guide assembly (20, 22 and 24), for guiding the crushing plate 12 toward the support plate 16 when the handle assembly is lowered. Projections 28 serve to extend a channel in the guide assembly above members 22 into that region 24 which connects the guide assembly to the mounting bar 2.

The lower support plate 16 is equipped with a ridge 14 for partially engaging a portion of a can to be crushed. The absence of this ridge at the front of plate 16 permits easy insertion of the can. The upper crushing plate 12 has a circular recessed region (shown in FIG. 6) into which the upper portion of the can fits during the crushing process. Crushing plate 12 is coupled to sliding member 10 which is guided by the guide assembly shown in more detail in FIGS. 2*A* and 2*B*. The slide member 10 is provided with a notch 11 to reduce friction between slide member 10 and the guide assembly.

The handle assembly includes lever members 6 which are pivotably coupled to the guide assembly at 7. Lever members 6 are joined by a handle 8. Lever members 6 are also coupled to crushing plate 12 by connecting members 18. Thus, it can be seen that as the handle assembly is lowered, the crushing plate 12 will be lowered by connecting members 18 and guided by slide member 10 which is retained within the guide assembly.

FIGS. 2*A* and 2*B* are front and top views of the above referred to guide channel.

FIG. 3 is a side view of the compactor after a can 31 has been placed in position and the handle assembly has been lowered until the crushing plate 12 just engages the top of can 31. It is important to note that in this position, the connecting members 18 are in a substantially vertical position. Thus, the downward force being applied to crushing plate 12 has virtually no horizontal component. In this manner, maximum efficiency is achieved when crushing begins.

Figure 5:
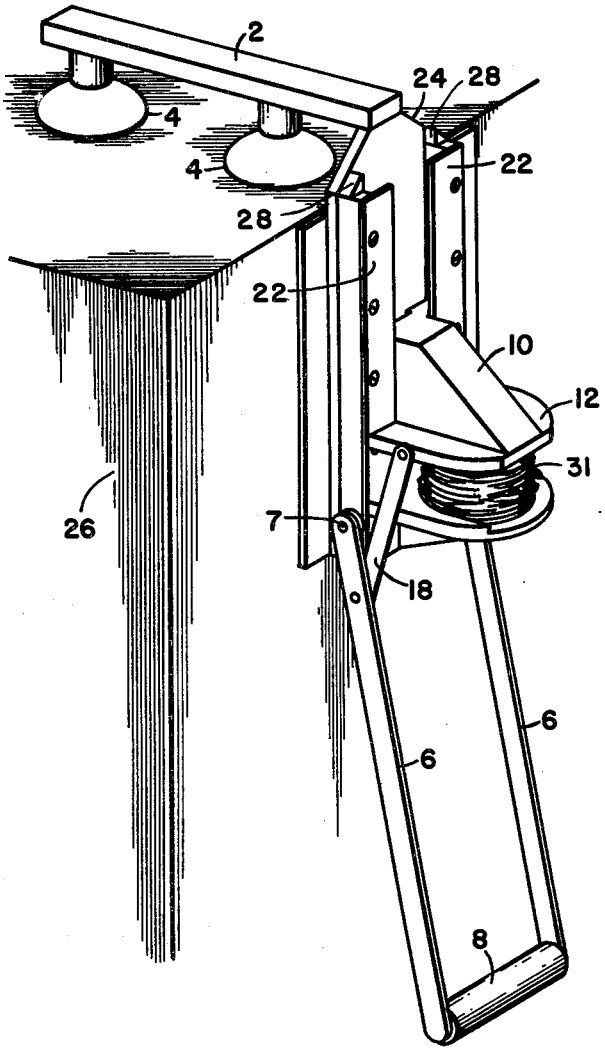
FIG. 5 illustrates the apparatus after crushing is complete.

As the handle assembly is lowered, can 31 becomes partially crushed, as is shown in FIG. 4. Finally, when the handle assembly is completely lowered as is shown in FIG. 5, the can is almost entirely crushed and ready for storage.

Figure 6:
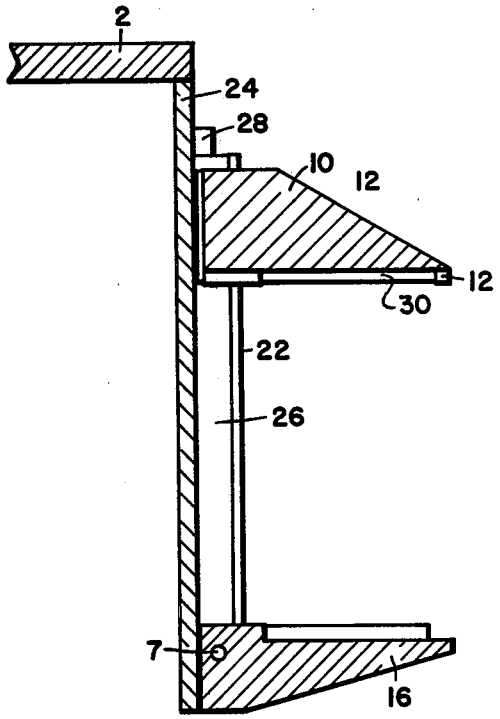
FIG. 6 is a cross-sectional view of the compactor shown in FIG. 1 taken along line 6—6.

FIG. 6 is a cross-sectional view of the inventive can compactor illustrating in more detail the guide assembly (FIGS. 2*A* and 2*B*), the positioning of slide member 10 within the guide assembly, the upper crushing plate 12 and the lower support plate 16. As referred to above, the crushing plate 12 has a recessed region 30 to provide support and positioning of a can during the crushing process.

While the invention has been particularly shown and described with reference to a preferred embodiment thereof, it will be understood by those skilled in the art that changes in form and details may be made therein without departing from the spirit and scope of the invention.

What is claimed is:

1. An apparatus for compacting aluminum containers, comprising:

guide means;

a first plate fixedly coupled to said guide means for supporting a container to be crushed, said first plate equipped with a ridge around a first portion of its periphery for defining a recessed surface which receives a first end of said container, the absence of said ridge at a second portion of said periphery permitting insertion of said container when said apparatus is in a rest condition;

crushing means slidingly coupled to said guide means, said crushing means including a ridge around its periphery to form a recessed central crushing surface for receiving a second end of said container; and a handle assembly pivotably coupled to said guide means and coupled to said crushing means for urging said crushing means against said container when said handle assembly is lowered.

2. An apparatus according to claim 1 wherein said crushing surface is and remains substantially parallel to said first plate throughout the crushing process.

3. An apparatus according to claim 2 wherein said handle assembly is coupled to said crushing means by at least one connecting member.

4. An apparatus according to claim 3 wherein said at least one connecting member assumes a substantially vertical position when said handle assembly is lowered sufficiently to bring said crushing means into contact with said container.

5. An apparatus according to claim 3 wherein said crushing means includes a slide member fixedly coupled to said crushing surface, which slide member is retained within said guide means for movement therein under the influence of said handle assembly.

6. An apparatus according to claim 5 wherein said guide means comprises a channeled plate in which said slide member is retained.

7. An apparatus according to claim 6 wherein said channeled plate lies in a plane substantially perpendicular to the planes of said first plate and said crushing surface.

8. An apparatus according to claim 6 wherein said slide member has at least one longitudinal slot for reducing friction as said slide member moves within said channeled plate.

9. An apparatus according to claim 6 further including means for mounting said guide means.

10. An apparatus according to claim 9 wherein said mounting means comprises:

a mounting bar coupled to said guide means; and at least one suction device coupled to said suction bar.

11. An apparatus for compacting containers, comprising:

a support member;

fixed guide means located on said support member;

means coupled to said guide means for supporting a container to be crushed, said means including a first plate equipped with a ridge around the first portion of its periphery for defining a recessed region on which a first end of said container is positioned, the absence of said ridge at a second portion of said periphery permitting insertion of said container once that apparatus is at a rest condition;

crushing means slidingly coupled to said guide means, said crushing means having a ridge around its periphery to form a recessed central crushing surface which receives a second end of said container; and means coupled to said support member and coupled to said crushing means for urging said crushing means against said container upon actuation thereof.

* * * * *